US011266278B1

(12) United States Patent
Lian et al.

(10) Patent No.: US 11,266,278 B1
(45) Date of Patent: Mar. 8, 2022

(54) LOCKING ASSEMBLY FOR FACILITATING DISASSEMBLY AND ASSEMBLY OF TOILET COVER PLATE ON MOUNTING HOLE

(71) Applicant: XIAMEN IPRACE INDUSTRIAL CO., LTD., Xiamen (CN)

(72) Inventors: Weisheng Lian, Xiamen (CN); Feng Guo, Xiamen (CN)

(73) Assignee: XIAMEN IPRACE INDUSTRIAL CO., LTD., Xiamen (CN)

( * ) Notice: Subject to any disclaimer, the term of this patent is extended or adjusted under 35 U.S.C. 154(b) by 0 days.

(21) Appl. No.: 17/106,220

(22) Filed: Nov. 30, 2020

(30) Foreign Application Priority Data

Oct. 20, 2020 (CN) ..... 202011126766.6

(51) Int. Cl.
*A47K 13/26* (2006.01)
*A47K 13/12* (2006.01)
*A47K 13/10* (2006.01)

(52) U.S. Cl.
CPC ..... *A47K 13/26* (2013.01); *A47K 13/10* (2013.01); *A47K 13/12* (2013.01)

(58) Field of Classification Search
CPC ..... A47K 13/10; A47K 13/26; A47K 13/12
See application file for complete search history.

(56) References Cited

U.S. PATENT DOCUMENTS

2012/0284909 A1* 11/2012 Chen ..... A47K 13/12 4/240

* cited by examiner

*Primary Examiner* — Christine J Skubinna

(57) ABSTRACT

A locking assembly for facilitating disassembly and assembly of a toilet cover plate on a mounting hole, comprising a bolt, a shaft sleeve in which a nut and a washer are fitted; two sides of the shaft sleeve are respectively provided with a upper guide groove and a lower guide groove, which are all parallel to an axial direction of the shaft sleeve, and bottoms of the upper guide grooves are narrowed to be steps and connect to tops of the lower guide grooves; the washer slidingly engages with the upper guide grooves by a rotating shaft, the nut slidingly engages with the lower guide grooves by guide ribs; the steps shelves the rotating shafts so that the washer is overhanging. The structure is compact and simple, it is convenient for assembly or disassembly, and has a high assembly and disassembly efficiency.

9 Claims, 17 Drawing Sheets

LOCKING ASSEMBLY FOR FACILITATING DISASSEMBLY AND ASSEMBLY OF TOILET COVER PLATE ON MOUNTING HOLE

CROSS REFERENCE TO RELATED APPLICATIONS

This application claims all benefits accruing under 35 U.S.C. § 119 from China Patent Application No. 202011126766.6, filed on Oct. 20, 2020, in the State Intellectual Property Office of China, the disclosure of which is incorporated herein by reference in its entirety.

TECHNICAL FIELD

The present disclosure relates to a quick assembly and connection of a toilet cover plate on a toilet ceramic seat, in particular to a locking assembly for facilitating disassembly and assembly of a toilet cover plate on a mounting hole.

BACKGROUND

The connection between a cover plate and a toilet ceramic seat is mainly through a cover plate support, bolts, washers, and nuts. First, the bolts go down through adjustment holes of the cover plate support and mounting holes on the ceramic seat, then the washers are inserted into the bolts under the ceramic seat, and then the nuts are screwed on with wrenches to make the nuts compress the washers and fix the cover plate support to the ceramic seat; because the ceramic seat is installed against a wall of a building, the space under the mounting holes on the ceramic base is narrow, it is inconvenient and time-consuming to tighten nuts by hand or using a wrench.

A quick-fitting bolt assembly for toilet cover plate, disclosed by the applicant in his earlier application for China Utility Model Patent (CN204181551U) (see paragraphs [0026]-[0031] of the specification, FIG. 1-9), comprises a bolt 10, a nut 20 attached to bolt 10, a washer 30 above nut 20, and a washer 30 comprises two parallel side plates 31, a spacing 32 is formed between the two side plates 31 letting the bolt 10 go through. A lug 33 for holding the bolt 10 in contact with the bolt 10 when the washer 30 rotates longitudinally is provided on the upper edge of the two side plates 31 and a counterweight block 34 for keeping the washer 30 turning downwards is projected between the lower edges of the two side plates 31. The quick-fitting bolt assembly for toilet cover plate has some problems is that when the cover plate support is installed, it need to pull up the bolt to press the washer 30 on the lower end of the mounting hole so that the washer 30 and the nut 20 stop turning and then rotate the bolt to lock; when removing the cover plate is removed, it need to pull up again so that the washer 30 is pressed on the lower end of the mounting hole and the washer 30 and the nut 20 stop turning, the bolt can be rotated and separated with the nut; for this reason, this bolt assembly is inconsistent with the usual means of handling bolts and takes time and effort to use.

SUMMARY OF THE DISCLOSURE

In order to solve the problems existing in the bolt assemblies for quick installation of the toilet cover plate, the present disclosure aims at proposing a locking assembly for facilitating disassembly and assembly of a toilet cover plate on a mounting hole. Operating above the mounting holes, the nuts and hanging state washers pre-installed under the back of the mounting holes, the nuts up is driven by bolts to push the washers upside down by 90 degrees to the horizontal state, so that the horizontal washer is hooked at back of the mounting holes. The quick installation of the cover plate support on the ceramic seat of the toilet is realized. Reverse the bolt to disengage it from the nut, and the washer is reset to the hanging state to realize the quick disassembly and disengagement of the cover plate support on the ceramic seat of the toilet.

To achieve the above, the present disclosure provides a locking assembly for facilitating disassembly and assembly of a toilet cover plate on a mounting hole, comprising a bolt, a nut and a washer, the locking assembly further comprises:

a shaft sleeve in which the nut and the washer are fitted, and the shaft sleeve is inserted into the mounting hole in the ceramic seat of the stationary toilet so that the nut and the washer are hung under a back of the mounting hole;

hanging arms of two sides of the shaft sleeve are respectively provided with a upper guide groove and a lower guide groove, two upper guide grooves and two lower guide grooves are all parallel to an axial direction of the shaft sleeve, and bottoms of the upper guide grooves are narrowed to be steps and connect to tops of the lower guide grooves;

two sides of the washer are respectively fixed with a rotating shaft, and the rotating shafts slidingly engages with the upper guide grooves, two sides of the nut have a guide rib respectively, and the guide ribs slidingly engages with the lower guide grooves; the steps shelves the rotating shafts so that the washer is overhanging;

the bolt is inserted into the shaft sleeve and screwed to a screw hole of the nut, when the nut moves up along the lower guide groove, the nut wedges the washer so that the washer can rotate 90° to expose out of the shaft sleeve in a horizontal state; the nut pushes the horizontal washer to be hooked on the back of the mounting hole while moving along the upper guide grooves.

The rotating shafts are located on a side of a gravity centre of the horizontal washer and the gravity centre of the washer is located under the rotating shaft when the washer is in an overhanging state; this design ensures that the rotating shaft of the washer is automatically aligned parallel to the axis of the shaft sleeve by its own weight when suspended in the shaft sleeve and that the shaft sleeve can be pulled through or out of the mounting hole.

The shaft sleeve further comprises a fastening ring connected at a top of the two hanging arms and a base plate connected at a bottom of the two hanging arms, a through groove is formed between the two hanging arms so that two ends of the washer can swing in the through groove; the shaft sleeve is inserted through the mounting hole, the fastening ring and the mounting hole tightly fix the shaft sleeve, the base plate enhances the overall structural strength of the shaft sleeve, the washer and the nut can be installed on the hanging arm through the through groove.

The fastening ring is provided with a socket for inserting bolt into the shaft sleeve, the fastening ring is surrounded by fins, and when the fastening ring is inserted into the mounting hole, the fins deform and press against a inner wall of the mounting hole to fix the fastening ring, so that the shaft sleeve is fixed in the mounting hole.

The base plate is provided with a let-through hole through which the bolt passes.

The washer comprises two strip side plates which are parallel to each other, each of the side plates has an upper edge that can be pressed against the back of the mounting hole and a lower edge that can be pressed against the top of the nut; a limit plate is provided between the lower edge of the two side plates, and a spacing is formed between the two side plates, the spacing let the bolt go through; when the washer is in overhanging state, the two side plates are parallel to an axial direction of the bolt, when the washer is in horizontal state, the limit plate is perpendicular to an axial direction of the bolt and clamps with the nut; this limits the angle at which the bolt drives the nut up to cause the washer to turn over to be 90 degrees.

Other ends of the two side plates are respectively provided with a wedge inclined surface, while the washer is upright, the nut is pushed upwards against the wedge inclined surface, and the nut pushes the wedge inclined surface so that the washer rotates to be in inclined state.

The lower edges of the two side plates is provided with a recessed clamping part matching with a side edge of the limit plate, the recessed clamping part is fitted with a side of the nut when the washer is turned horizontally; this design ensures that the nut does not been driven by the bolt rotate horizontally when it moves axially into the upper guide groove and disengages from the lower guide groove.

The rotating shafts on both sides of the washer are protruded on the two side plates of outer side of the spacing.

The beneficial effects of the present disclosure are as follows:

(1) By operating the bolt only above the mounting hole, the washer can be rotated horizontally and be hooked and fixed on the back of the mounting hole, making the cover plate more convenient to be installed on the ceramic seat of the toilet.

(2) Disassembly does not require operation on the back of the mounting hole, the nut can be detached by directly rotating reversely the bolt, the bolt pulls out the shaft sleeve so that the cover plate can be installed more conveniently on the ceramic seat of the toilet.

The drawings are identified as: 10. bolt; 20. nut; 21. screw hole; 22. guide rib; 30. washer; 301. shaft; 31. side plate; 311. upper edge; 312. lower edge; 313. wedge inclined surfaced surface; 314. recessed clamping parting part; 32. limit plate; 33. spacing; 40. shaft sleeve; 41. fastening ring; 411. socket; 412. fin; 42. hanging arm; 421. upper guide groove; 422. lower guide groove; 423. step; 43. base plate; 431. let-through hole; 44. through groove; 50. cover plate support; 51. adjustment hole; 60. toilet ceramic seat; 61. mounting hole.

DETAILED DESCRIPTION

The present disclosure is further described below in connection with the accompanying drawings and implementation examples.

A locking assembly for facilitating disassembling and assembling a toilet cover plate on a mounting hole, shown in FIG. 1-17, comprises a bolt 10, a nut 20, a washer 30 and a shaft sleeve 40.

The structure of each component of the present disclosure is described separately below.

Figure 1:
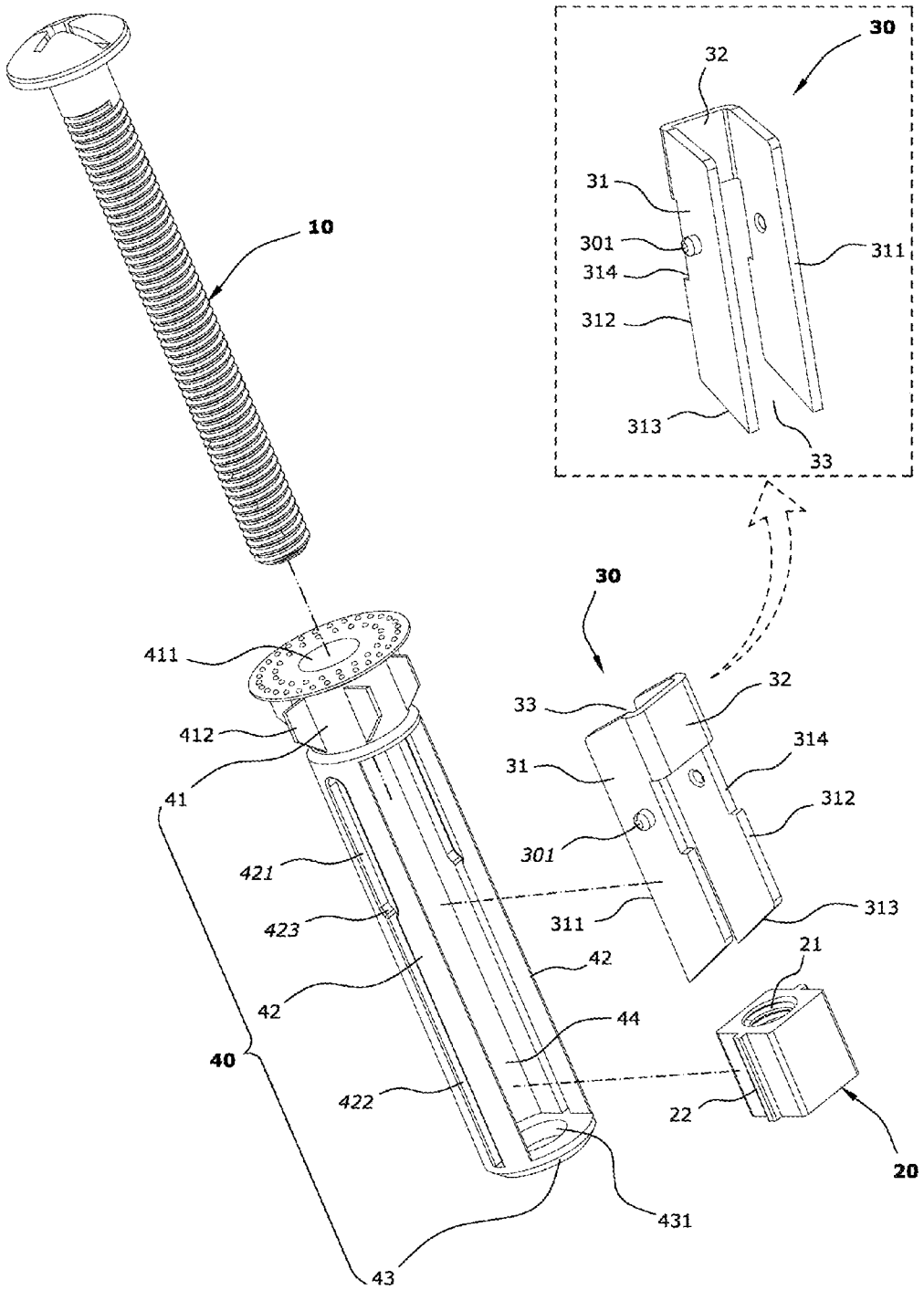
FIG. 1 is first exploded diagram of a three-dimensional locking assembly structure of the disclosure.
Figure 2:
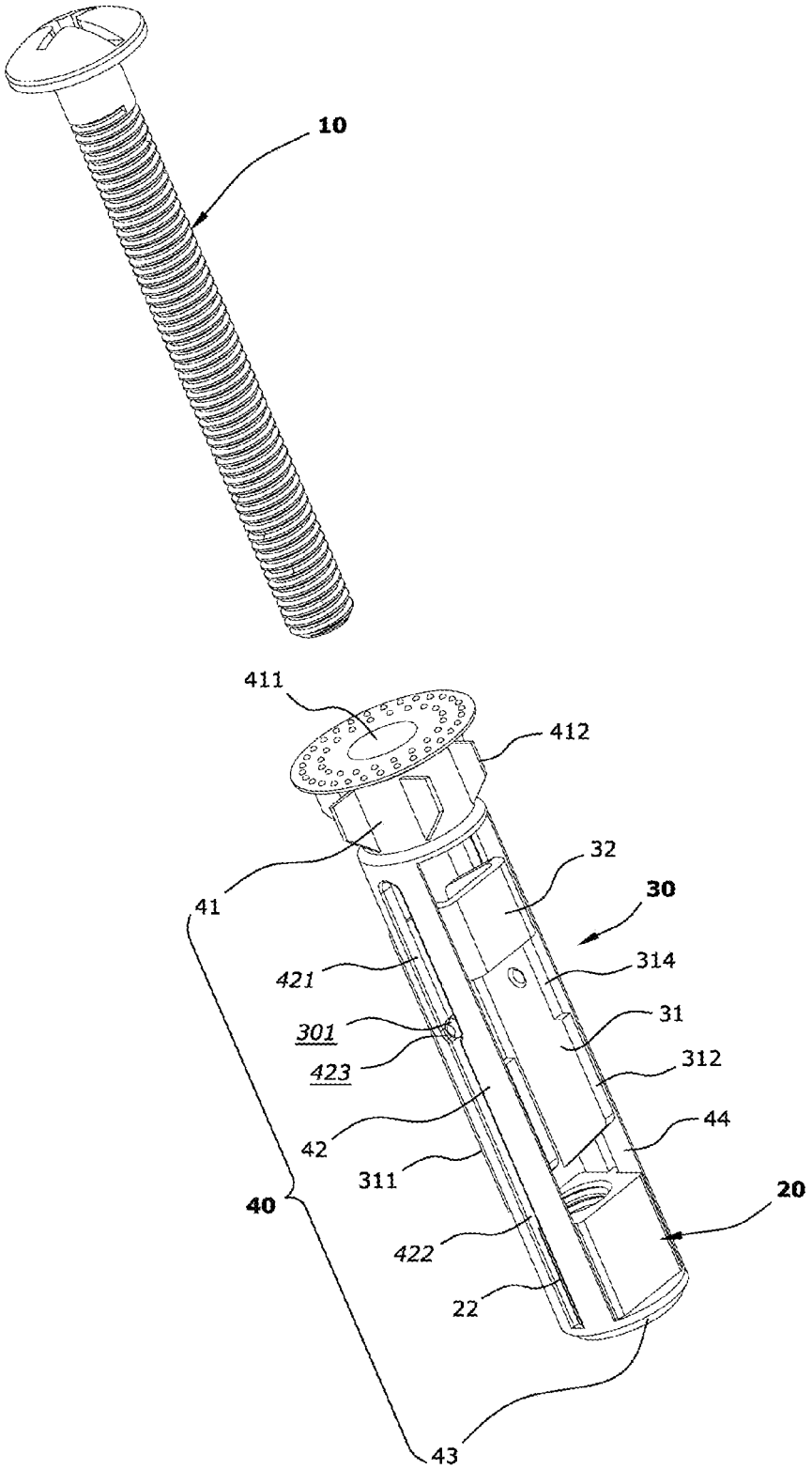
FIG. 2 is second exploded diagram of a three-dimensional locking assembly of the present disclosure.
Figure 3:
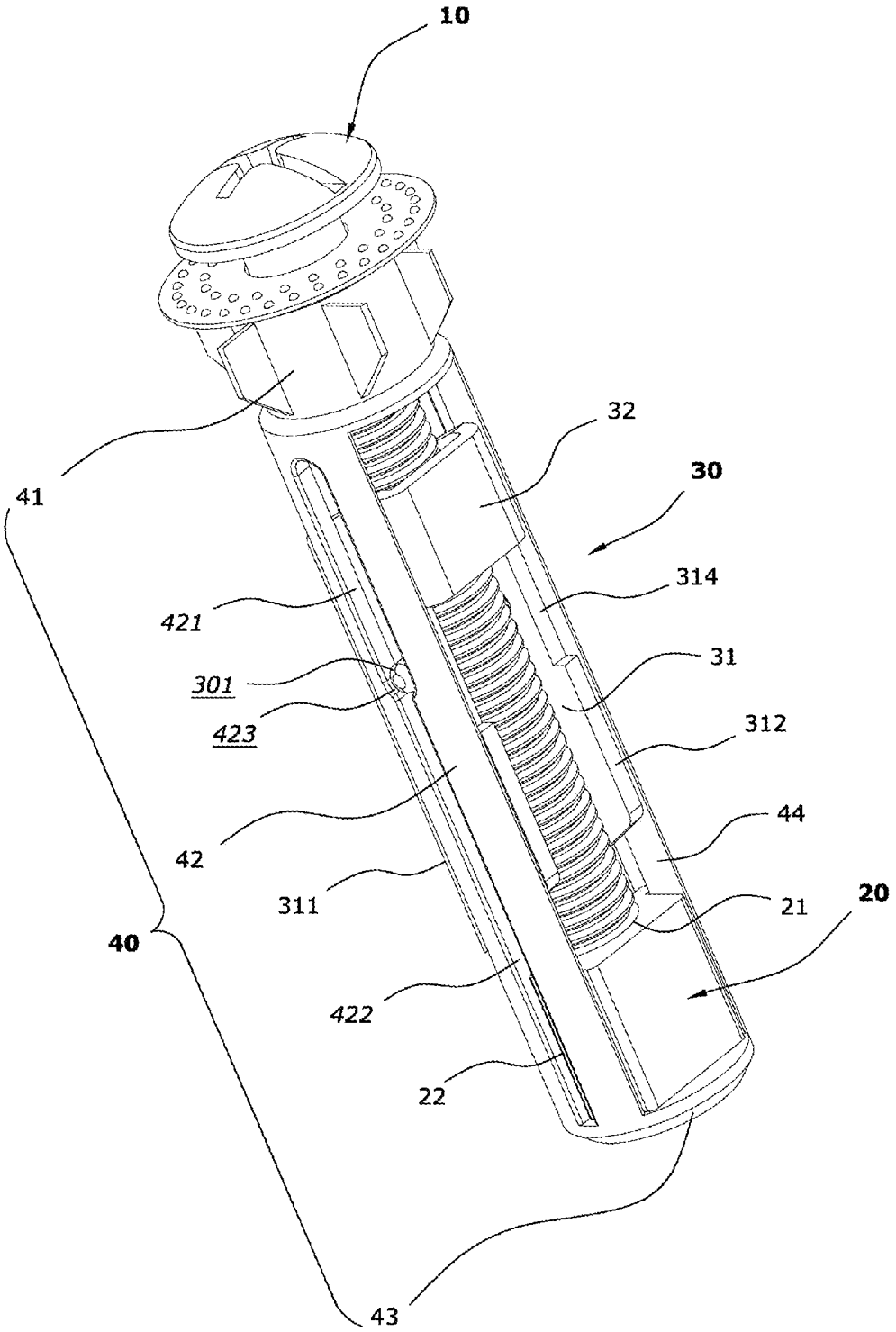
FIG. 3 is a structural diagram of a three-dimensional locking assembly of the present disclosure after assembly.
Figure 4:
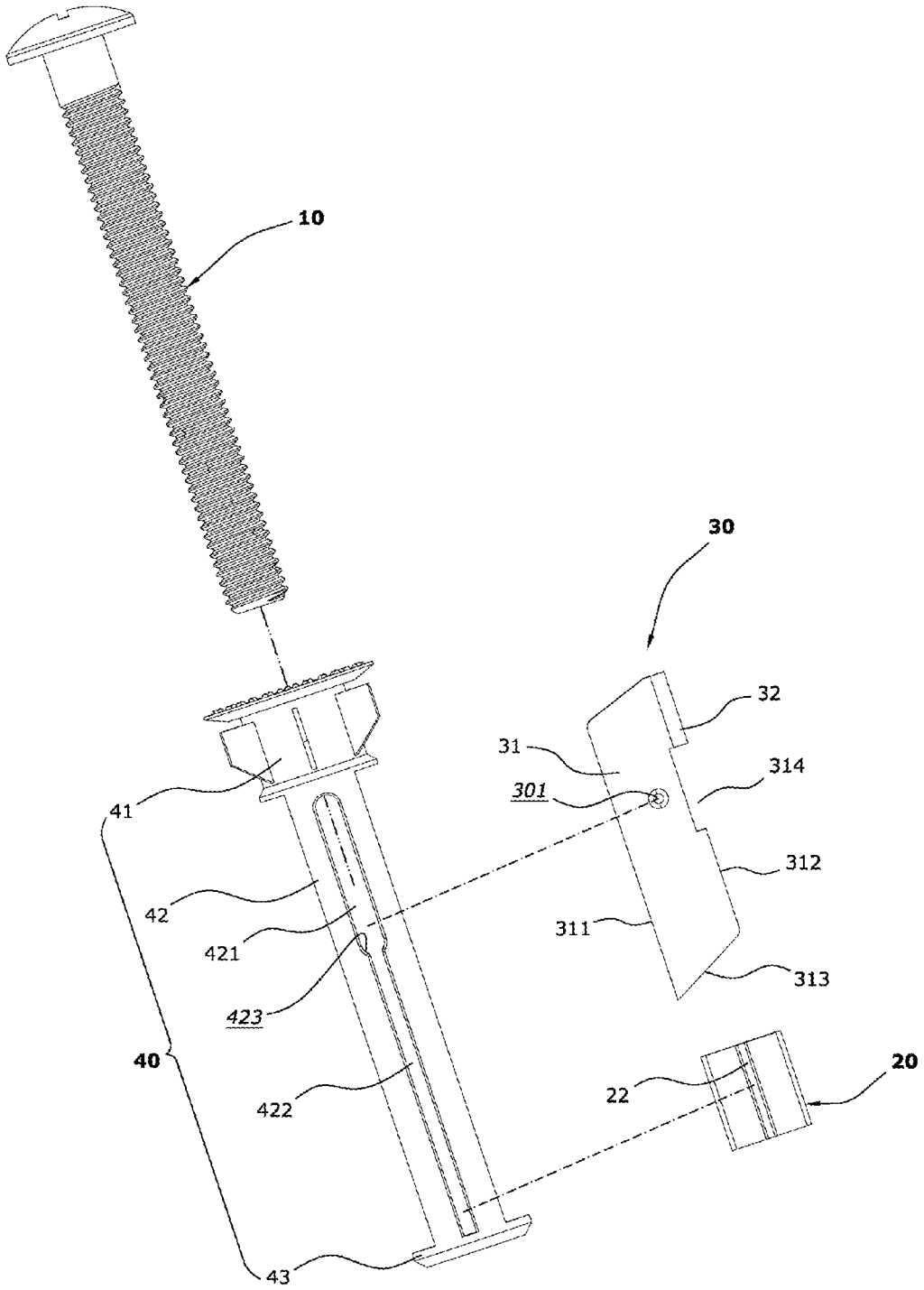
FIG. 4 is first side-view plane exploded diagram of a locking assembly of the present disclosure.

As shown in FIGS. 1 and 4, the bolt 10 of the present disclosure employs a universal toilet cover mounting bolt.

As shown in FIGS. 1 and 4, the nut 20 of the present disclosure employs a hexagonal cylindrical nut with a screw hole 21, each of two opposite sides of the nut 20 is provided with a guide rib 22.

As shown in FIGS. 1 and 4, the washer 30 of the present disclosure includes two parallel strip-shaped side plates 31. Each of the side plates 31 has an upper edge 311 which can abut with the back of the mounting hole 61 and a lower edge 312 which can be abut with the top of the nut 20; one ends of the lower edges 312 of the side plates 31 are provided with a limit plate 32, and the other ends of the side plates 31 are provided with wedge inclined surfaced surfaces 313; each of the lower edges 312 of the side plates 31 is provided with a recessed clamping part 314 which is formed along the side of the limit plate 32; and a spacing 33 between the two side plates 31 lets the bolt 10 to go through. Two sides of the washer 30 are respectively fixed with a rotating shaft 301, and the rotating shafts 301 are located on a side of a gravity centre of the horizontal washer 30 and the gravity centre of the washer 30 is located under the rotating shaft 301 when the washer 30 is in an overhanging state.

As shown in FIGS. 1 and 4, the shaft sleeve 40 of the present disclosure includes two hanging arms 42, a fastening ring 41 connected at the top of the two hanging arms 42, and a base plate 43 connected at the bottom of the two hanging arms 42. A through groove 44 is formed between the two hanging arms 42 to let the two ends of the washer 30 swing in and out. A socket 411 for bolt 10 to insert into the shaft sleeve 40 is provided on the fastening ring 41, and a number of fins 412 are fixed around the fastening ring 41. The base plate 43 is provided with an let-through hole 431 for bolt 10 to pass through. Two upper guide grooves 421 and two lower guide grooves 422 parallel to the shaft sleeve 40 are arranged in opposite direction on the two hanging arms 42. The bottom ends of the upper guide grooves 421 are narrowed to form steps 423 which are connected with the top ends of the lower guide grooves 422.

The assembly of the disclosure is described below.

As shown in FIG. 1, FIG. 2, FIG. 4 and FIG. 5, first, the nut 20 is pressed from through groove 44 to the two upper guide grooves 421 between the two hanging arms 42, so that guide ribs 22 of both sides of nut 20 are set into the upper guide groove 421 and fall freely under the action of gravity of nut 20. The nut 20 slides down into the lower guide groove 422 through the guide rib 22 until the bottom surface of nut 20 is shelved by base plate 43, thus realizing that the nut 20 is installed in shaft sleeve 40 without rotation. Then the washer 30 is pressed into the two upper guide grooves 421 between the through grooves 44 so that the rotating shaft 301 on both sides of the washer 30 are inserted into the upper guide grooves 421 on the two hanging arms 42. Constrained by the two rotating shaft 301 and the two upper guide grooves 421, the washer 30 cannot rotate horizontally. After releasing, the washer 30 falls freely under its own gravity, the rotating shaft 301 slides along the upper guide grooves 421 to the bottom of the upper guide grooves 421 and is shelved by the steps 423. Since the center of gravity of the washer 30 is below the rotating shaft 301, when the washer 30 is suspended at step 423, it automatically swings around the rotating shaft 301 to hang vertically parallel to the axis of the shaft sleeve 40. When the washer 30 is hanging vertically, the upper edge of the side plate 31 and the lower edge 312 is parallel to the axis of the shaft sleeve 40, the wedge inclined surface 313 at the bottom of the side plate 31 is opposite to the corner of the nut 20 under the washer 30. So far, the pre-installation of the nut 20 and the washer 30 into the shaft sleeve 40 has been completed. Then, as shown in FIG. 1, FIG. 2 and FIG. 3, FIG. 5 and FIG. 6, the bolt 10 is aligned with the socket 411 of the fastening ring 41, the bolt 10 is inserted into the shaft sleeve 40 through the socket 411, and the bolt 10 is connected with the screw hole 21 of the nut 20 at the bottom of shaft sleeve 40 after going though the let though hole 33 of the washer 30; thus, the overall assembly of the disclosure has been completed. When the washer 30 is in the upright state, the limit plate 32 is parallel to the axial direction of the bolt 10, and when the washer 30 is in the holding state, the limit plate 32 is perpendicular to the axial direction of the bolt 10 and clamps with the nut 20 to limit the angle of the washer 30 turning at shaft sleeve 40 to 90 degrees.

The following details the working principle of the disclosure and the application of the present disclosure to install and remove the cover plate on the ceramic seat of the toilet.

Figure 11:
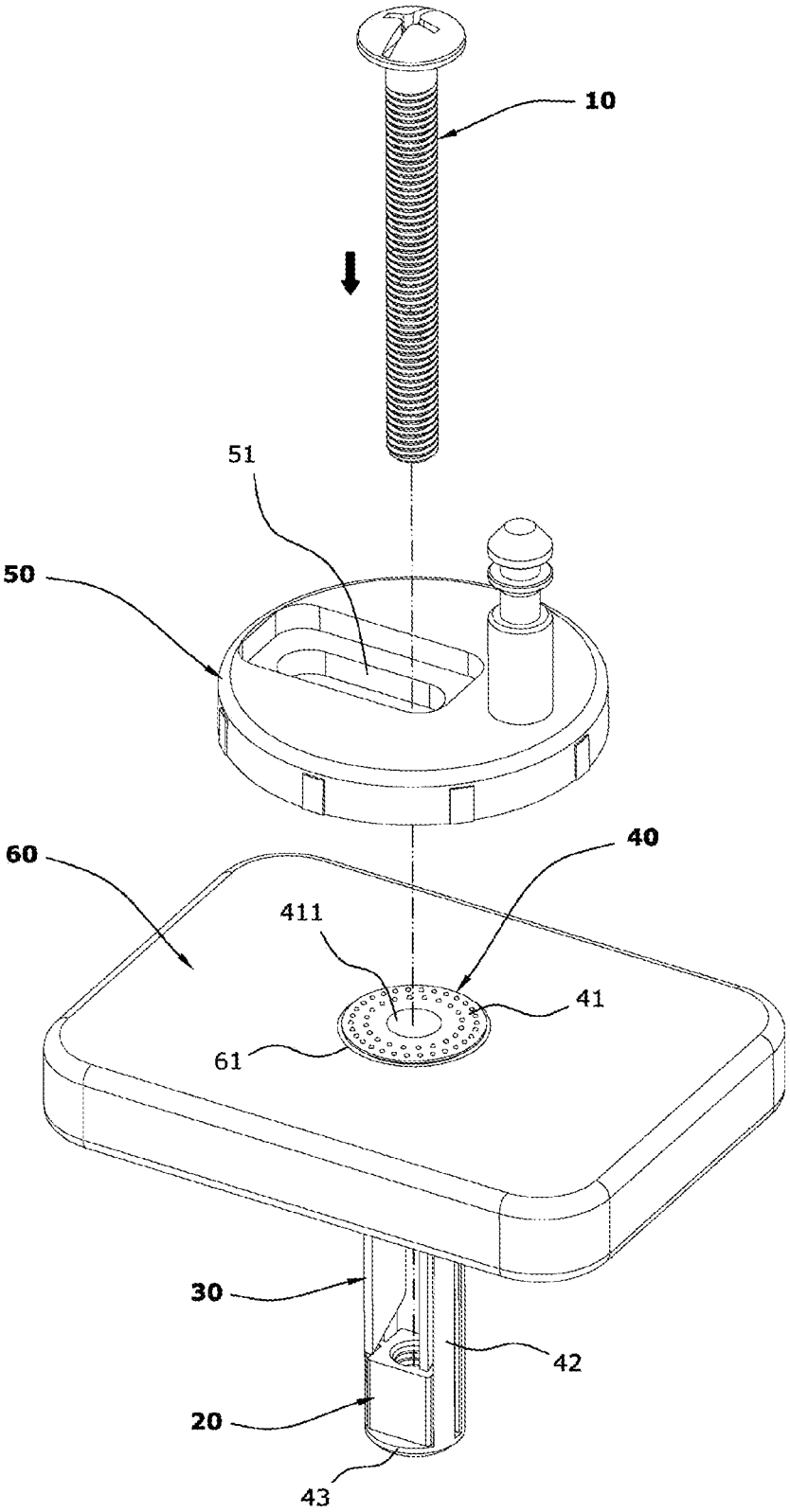
FIG. 11 is a three-dimensional structural diagram of installing a cover plate on a ceramic toilet seat using the present disclosure.
Figure 12:
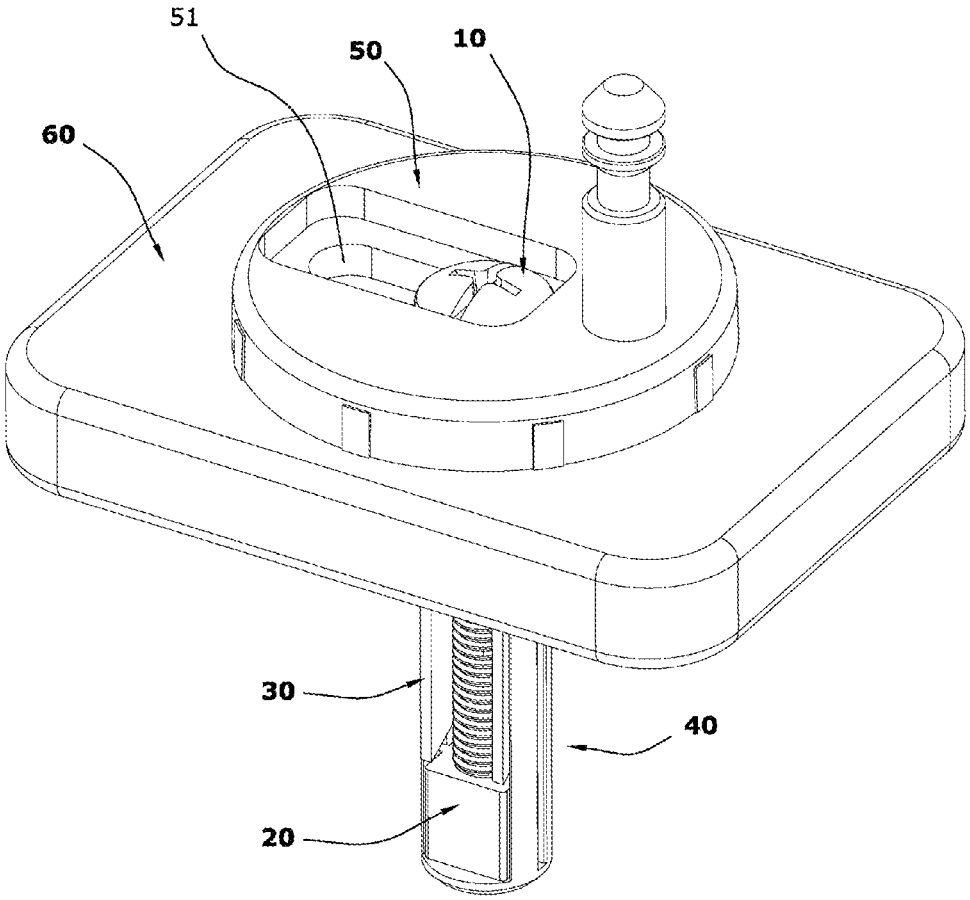
FIG. 12 is a top-view three-dimensional diagram of a washer of the present disclosure in which a cover plate installed on a ceramic toilet seat with washers upright.
Figure 13:
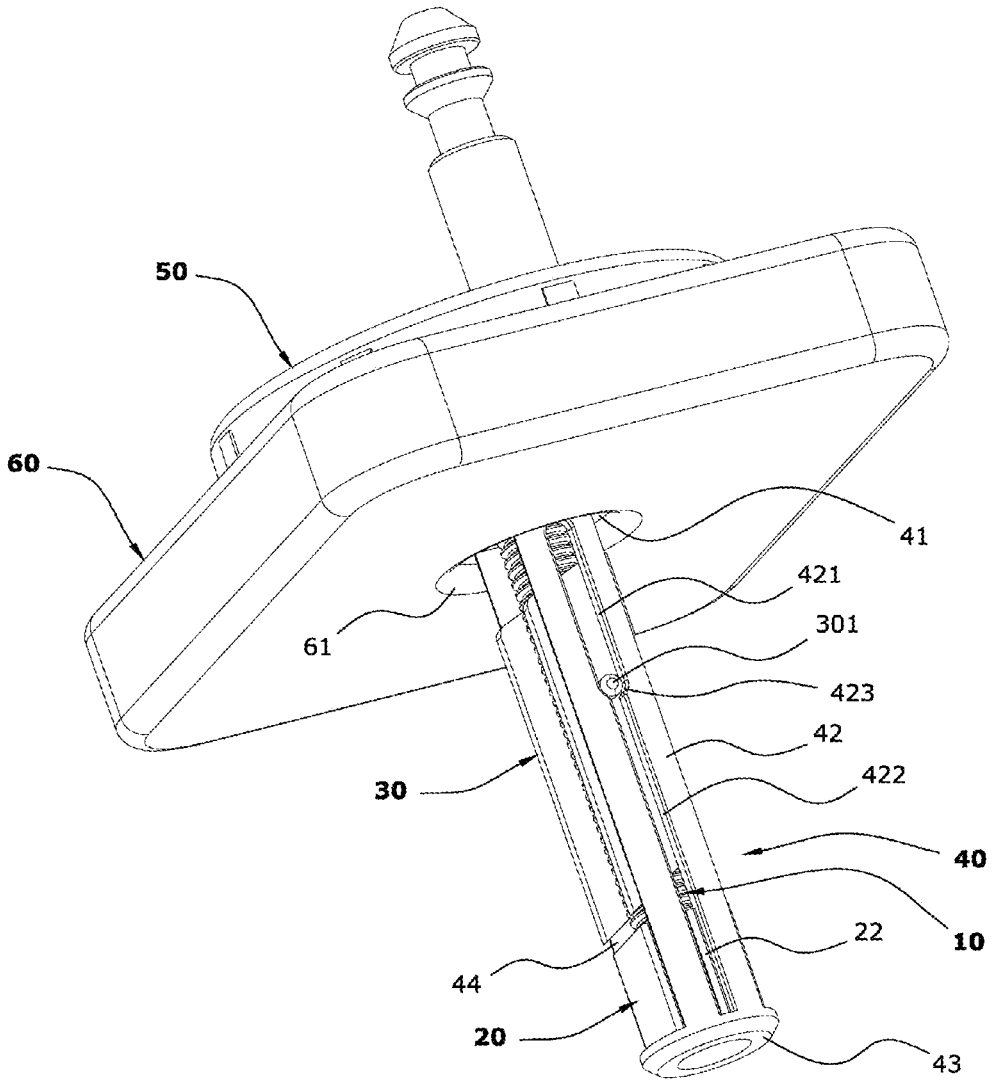
FIG. 13 is a bottom-view three-dimensional diagram of a washer of the present disclosure in which a cover plate installed on a ceramic toilet seat with washers upright.

As shown in FIG. 11-FIG. 13, the shaft sleeve 40 with the nut 20 and the washer 30 is pushed down through the mounting hole 61 on the ceramic seat 60 of the toilet, so that the fastening ring 41 at the end of the shaft sleeve 40 is fitted into the mounting hole 61, and the elastic deformation of several fins 412 fix the fastening ring 41 on the inner wall of the mounting hole 61 and the fastening ring 41 is fixed to stop rotating, realizing that the shaft sleeve 40 can be fixed on the ceramic seat 60, so that the washer 30 is hung under the back of mounting hole 61 through the shaft sleeve. Then the bolt 10 is inserted into the adjustment hole 51 of the cover plate support 50 and the socket 411 of the fastening ring 41 to connect with the nut 20.

Figure 6:
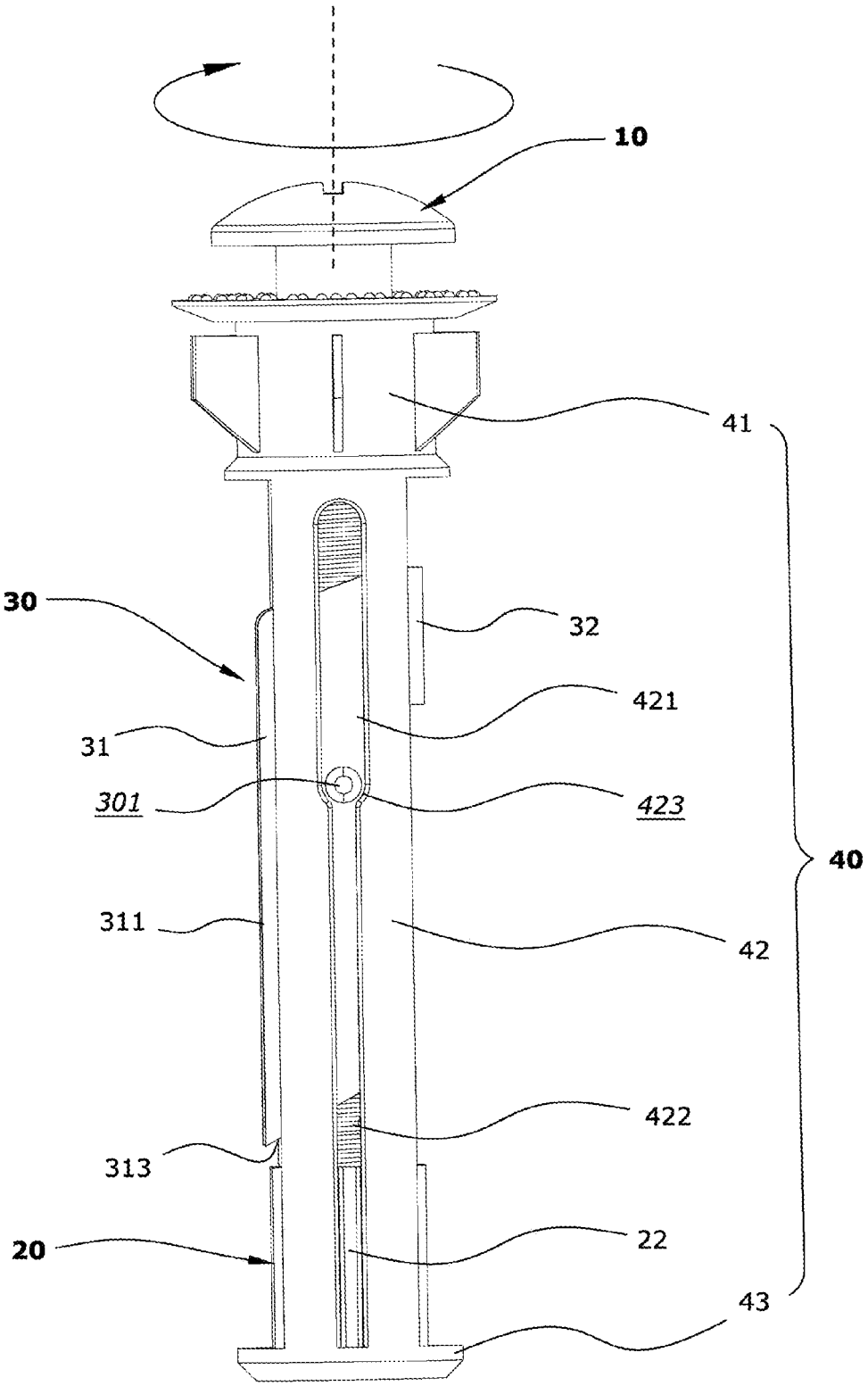
FIG. 6 is a side-view plane structural diagram of a three-dimensional locking assembly of the present disclosure after assembly.

As shown in FIG. 6, FIG. 12 and FIG. 13, the upright state of the washer 30 is the initial state of the disclosure, and the nut 20 is located below the washer 30, and the nut 20 is opposite to the wedge inclined surfaces 313 of the side plates 31 of the washer 30. Turn the bolt 10 clockwise, with the guide rib 22 and the lower guide grooves 422, the nut 20 rises to the top of the shaft sleeve 40 along the lower guide grooves 422.

Figure 7:
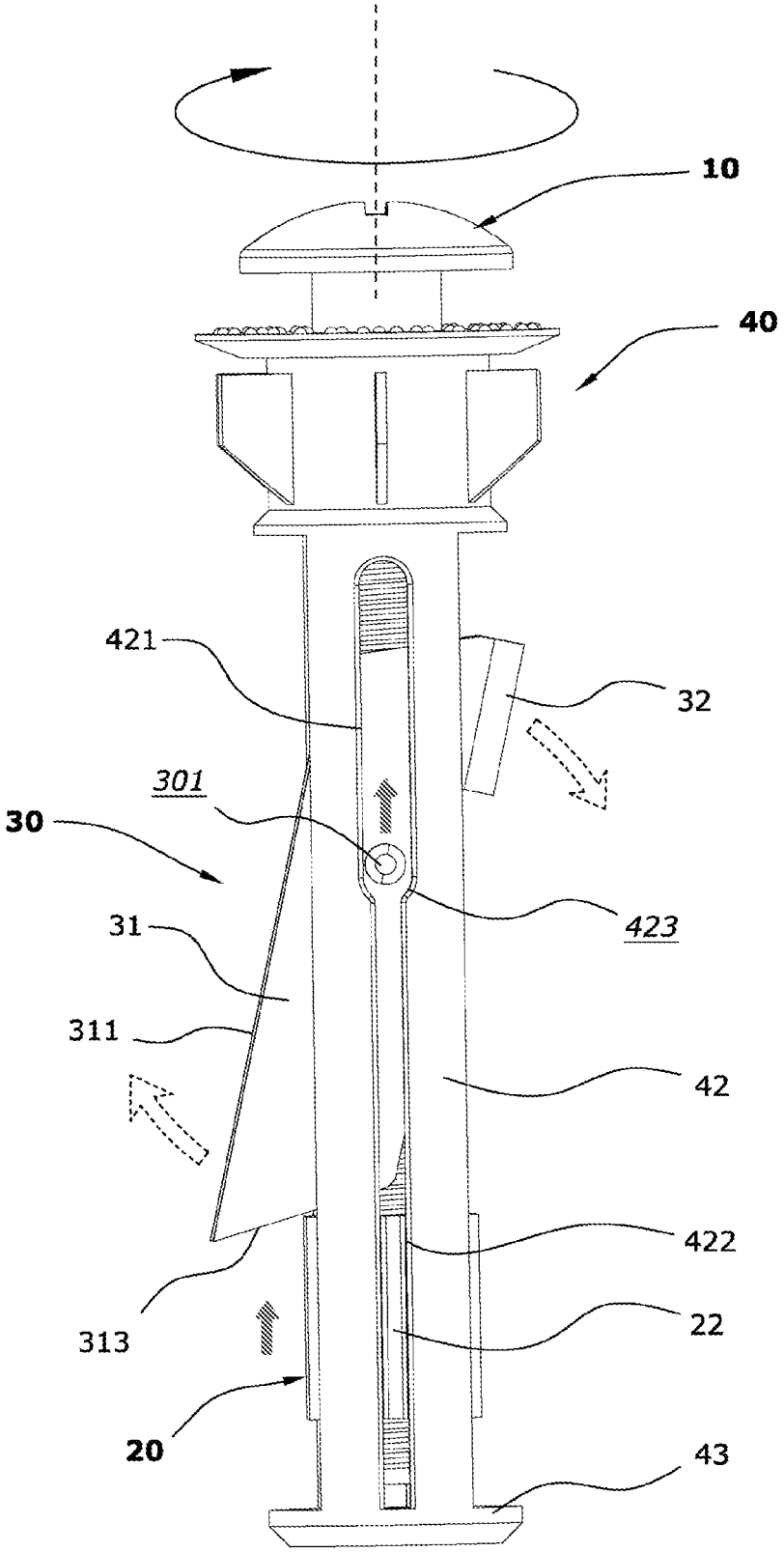
FIG. 7 is a schematic diagram of the present disclosure in which the nut pushing the washer to swing longitudinally.

As shown in FIG. 7, the angle of the nut 20 is lifted along the wedge inclined surface 313 to raise the washer 30, so that the rotating shaft 301 rises under the guidance of the upper guide grooves 421 and the rotating shaft 301 disengages from the steps 423. Under the dual action of the pushing of the nut 20 and the gravity of the heavy washer 30 itself, the support of the center of gravity of the washer 30 on the wedge inclined surface 313 becomes unstable, thus the wedge inclined surface 313 slides downward along the angle of the nut 20. The way in which the center of gravity of the washer 30 loses its stable support causes the washer 30 to rotate, causing both ends of the washer 30 to swing out of the through grooves 44.

Figure 8:
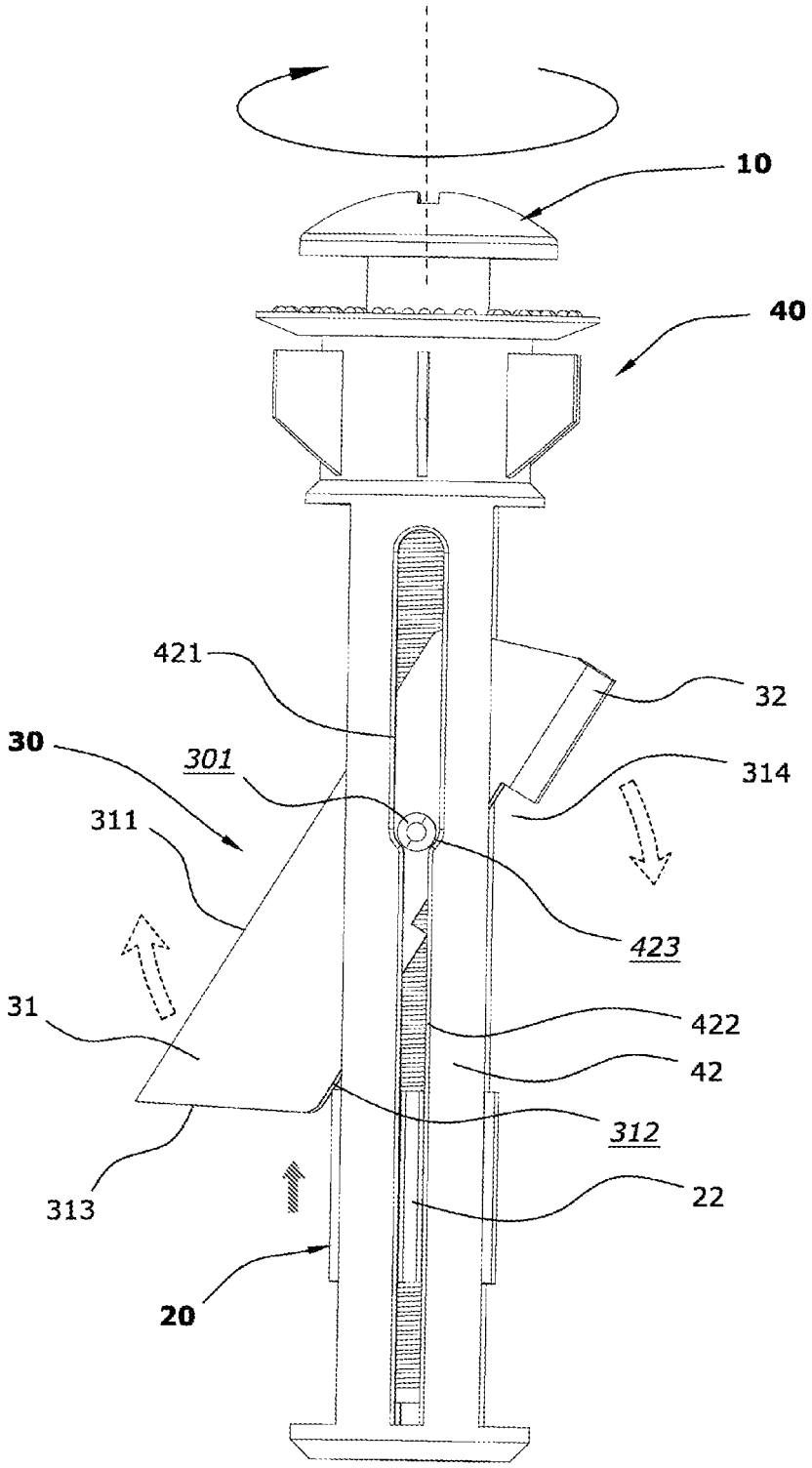
FIG. 8 is a schematic diagram of the present disclosure in which the nut is wedged up the washer to continue to swing longitudinally.
Figure 9:
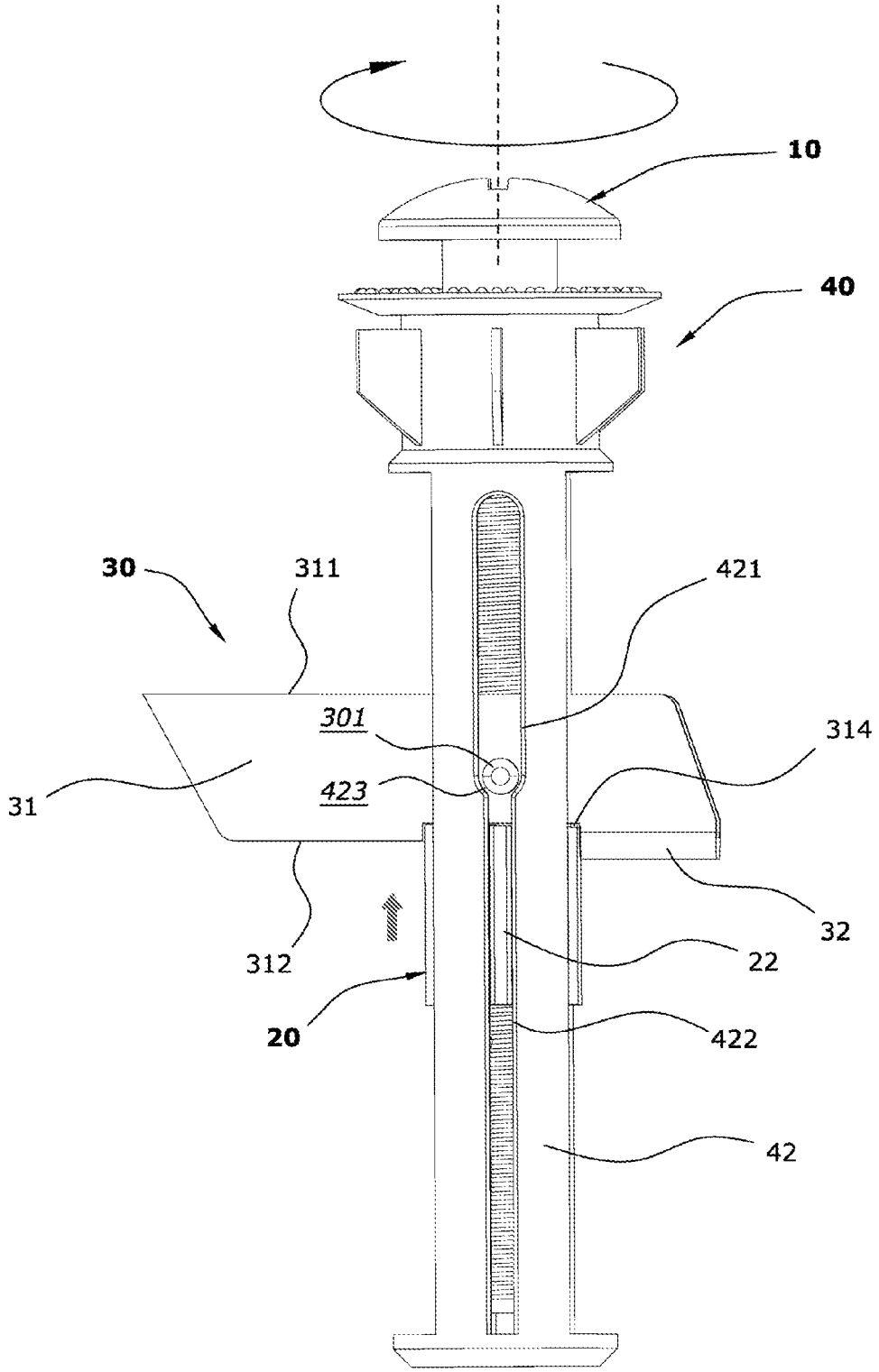
FIG. 9 is a schematic diagram of the present disclosure in which when the nut and the lower edge of the washer are clamped, the washer is in horizontal state.
Figure 14:
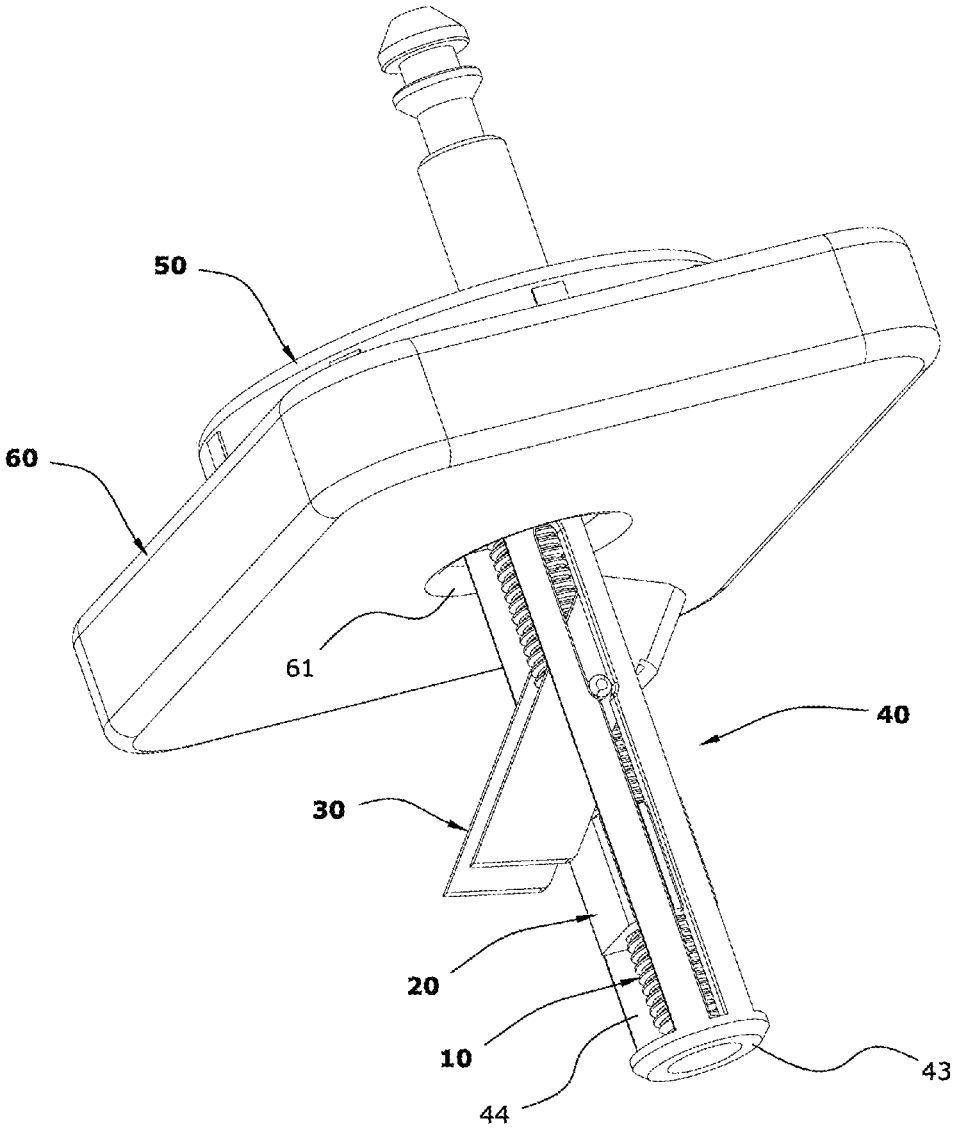
FIG. 14 is structural schematic of the present disclosure in which the washer swings longitudinally under the bottom surface of the mounting hole.
Figure 15:
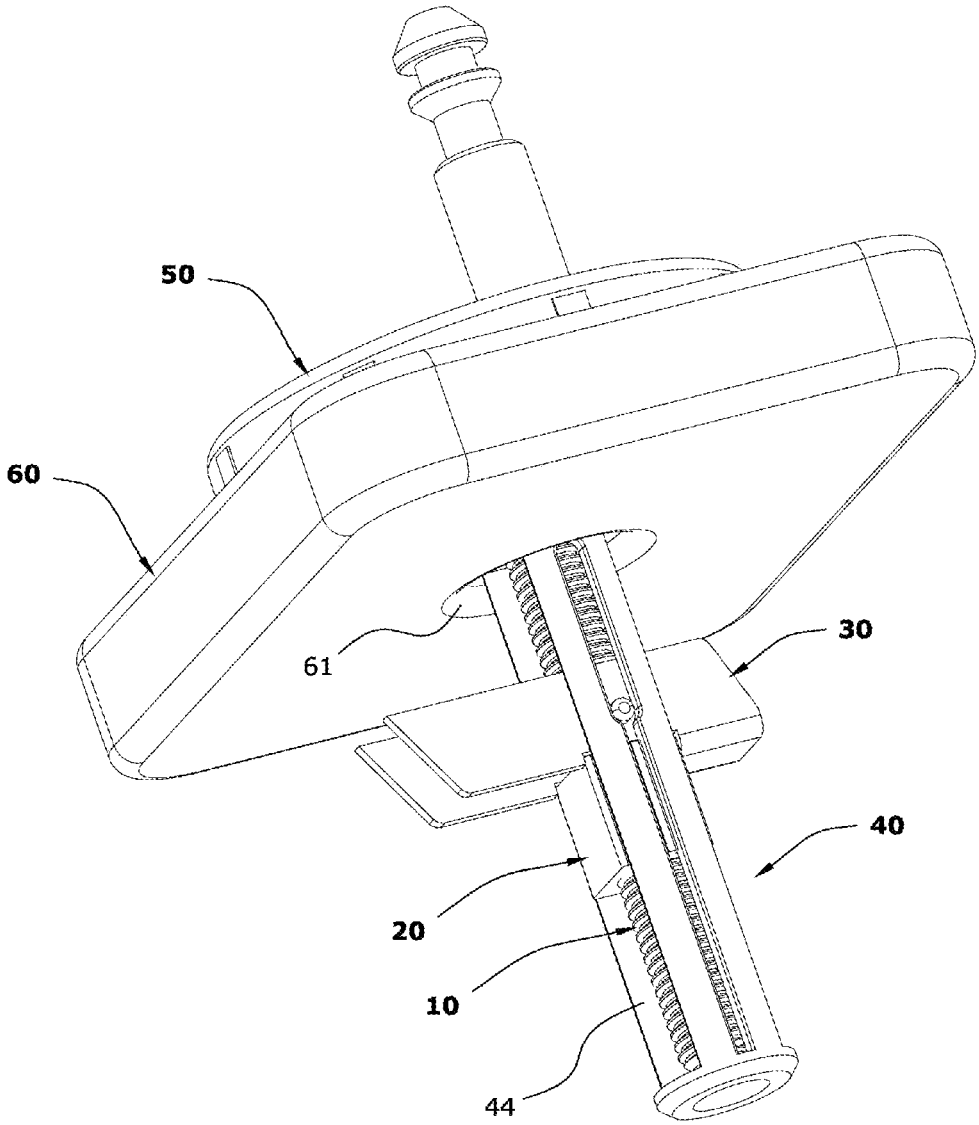
FIG. 15 is a three-dimensional structural diagram of the present disclosure in which the washer is in a horizontal state under the bottom surface of the mounting hole.

As shown in FIG. 8 and FIG. 14, when the wedge inclined surfaces 313 slip off the nut 20, the washer 30 falls back, the rotating shaft 301 slides down along the upper guide grooves 421 to the steps 423 to support the washer 30. As the nut 20 continues to rise along the lower guide grooves 422, the lower edge of the inclined side plates 31 is pushed by the nut 20 so that the washer 30 continues to rotate with the rotating shaft 301 as the turning center at steps 423 until the washer 30 rotates to 90 degrees horizontally, as shown in FIG. 9 and FIG. 15, the recessed clamping part 314 of the lower edges 312 of the side plates 31 of the washer 30 is clamped on the side of the nut 20, thus causing the nut 20 to stop twisting on the horizontal washer 30. So far, the washer 30 is pressed to rotate 90 degrees horizontally while the nut 20 moves up along the lower guide grooves 422, so that both ends of the washer 30 fully extend to expose out of the shaft sleeve 40.

Figure 10:
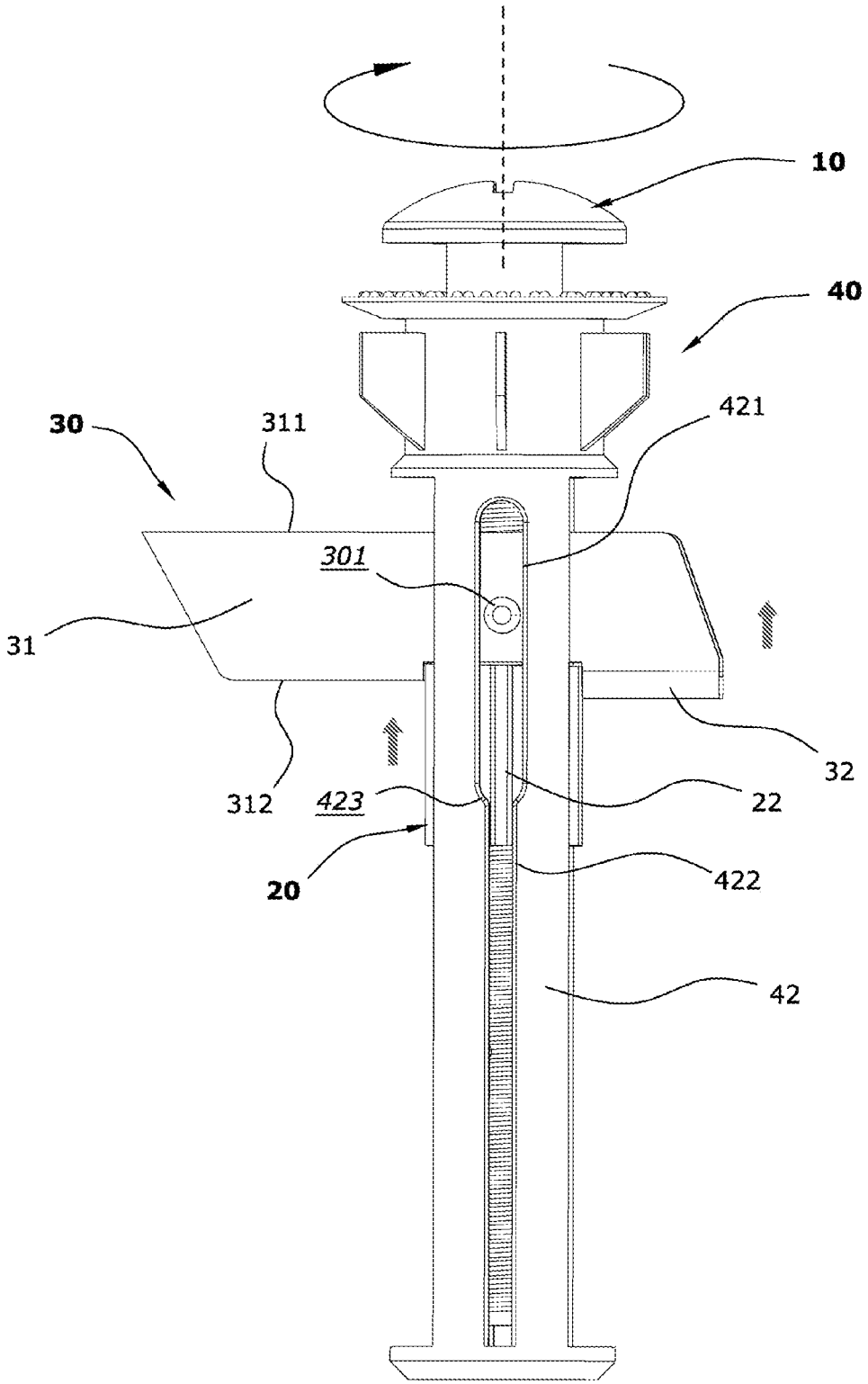
FIG. 10 is a structural schematic of the present disclosure in which a nut rises with a horizontal washer together.
Figure 16:
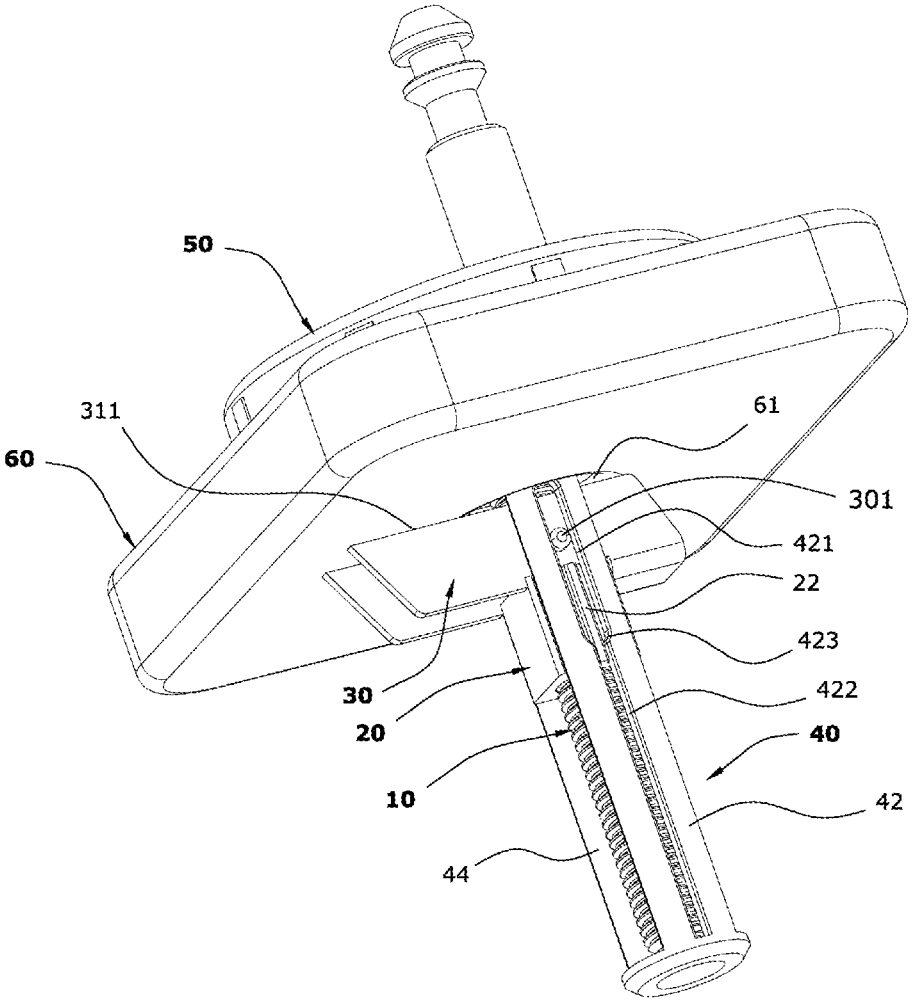
FIG. 16 is a three-dimensional structural diagram of the disclosure in which the washer is hooked and anchored to the bottom surface of the mounting hole.

As shown in FIG. 10 and FIG. 16, as the nut 20 continues to rise along the lower guide grooves 422 and enters the upper guide grooves 421 through the steps 423, the rotating shaft 301 of the washer 30 is released from the steps 423 under the guide of the upper guide grooves 421, and of the nut 20 goes up and pushes the washer 30, so that the nut 20 goes up along the upper guide grooves to push the washer 30 and be clipped to the back of mounting hole 61. By tightening the bolt 10, the cover plate support 50 can be locked and fixed on the ceramic seat 60 of the toilet seat.

Figure 5:
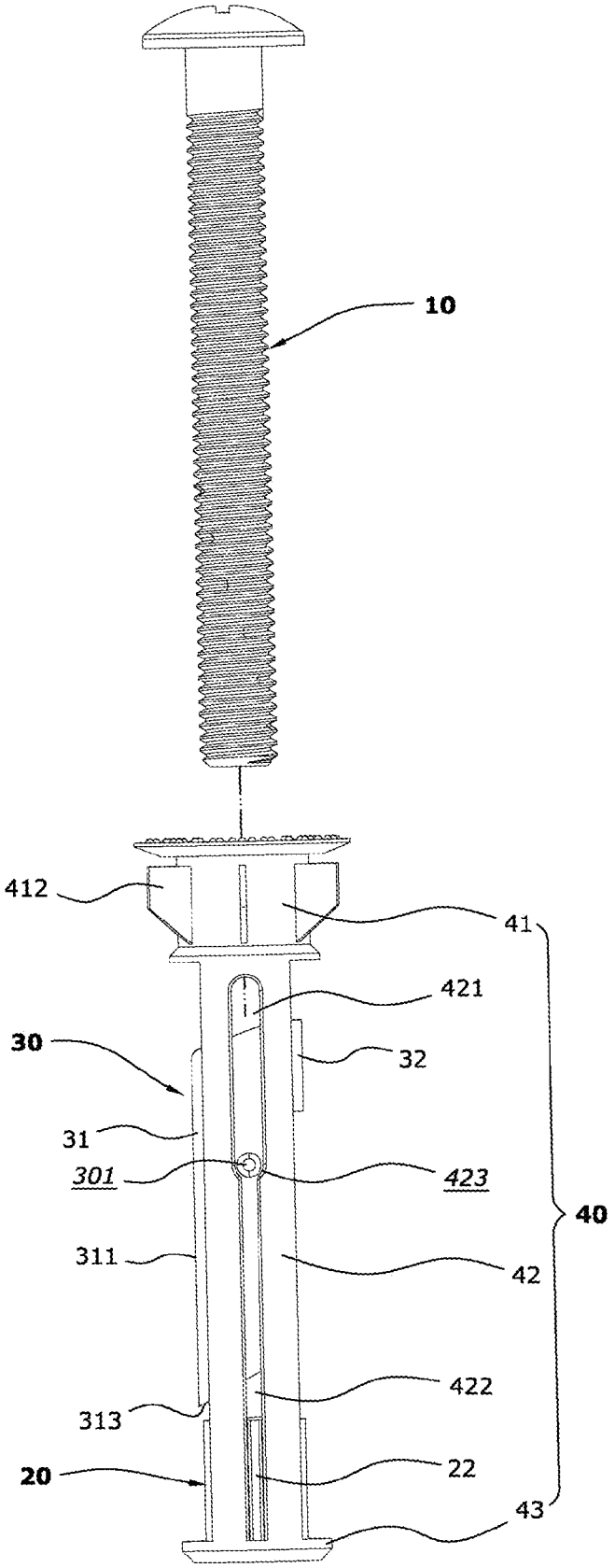
FIG. 5 is second side-view plane exploded diagram of a locking assembly of the present disclosure.
Figure 17:
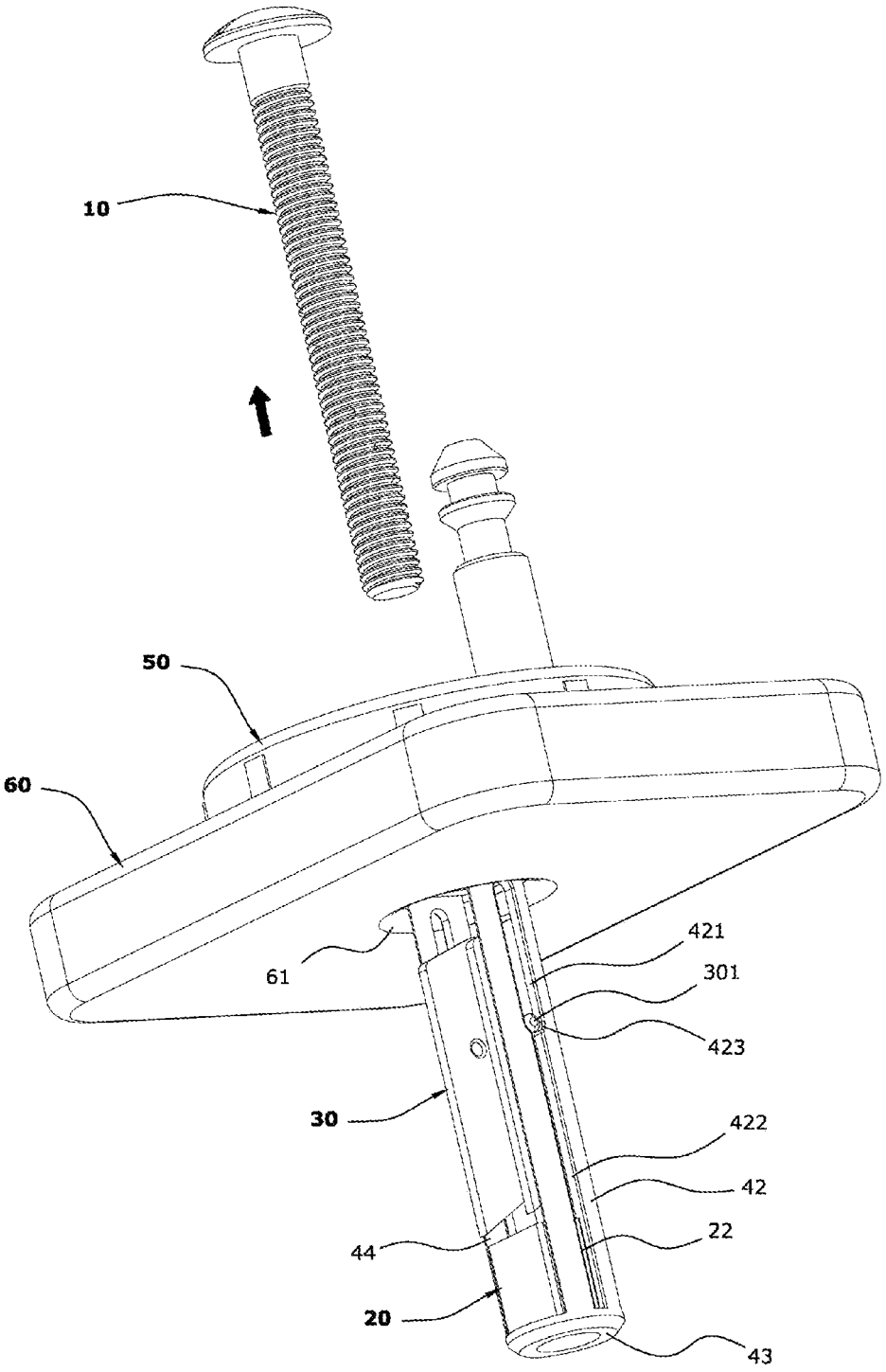
FIG. 17 is a three-dimensional structural diagram of the disclosure in which the cover plate and the toilet ceramic seat can be separated when the bolt are removed.

As shown in FIG. 10, FIG. 5 and FIG. 17, counter-rotating the bolt 10 causes the nut 20 to slide from the upper guide grooves 421 to the bottom of the lower guide grooves 422. The washer 30 falls back under the guidance of self-weight and the rotating shaft 301 falls back at upper guide grooves 421. When the rotating shaft 301 falls back to the steps 423 and the nut 20 and the washer 30 are separated from the shaft sleeve 40, the washer 30 automatically rotates to be in hanging state under self-weight and pulls the bolt 10 out of the shaft sleeve 40. The removal and disengagement of the cover plate support 50 on the ceramic seat 60 of the toilet can be achieved.

Using the present disclosure, it is possible to operate over the toilet ceramic seat 60 and pull the shaft sleeve 40 out of the mounting hole 61, so that the nut 10, the washer 30 and the shaft sleeve 40 can be taken out of the mounting hole 61 together. Similarly, the shaft sleeve 40 can be operated over the toilet ceramic seat 60, and the shaft sleeve 40 can be inserted into the mounting hole 61 so that the nut 10 and the washer 30 can be pre-installed under the back of the mounting hole 61. Furthermore, with the match of the shaft sleeve 40, the operating above the ceramic seat 60 is easily and convenient.

The above embodiments are for the purposes of illustrating the disclosure only and are not a limitation of the disclosure; ordinary technicians in the field of technology may also make various changes or changes without departing from the spirit and scope of the disclosure; therefore, all equivalent technical schemes should also fall within the scope of the disclosure and be limited by each claim.

What is claimed is:

1. A locking assembly for facilitating disassembly and assembly of a toilet cover plate on a mounting hole, comprising a bolt (10), a nut (20) and a washer (30), wherein the locking assembly further comprises:

a shaft sleeve (40) in which the nut (20) and the washer (30) are fitted, and the shaft sleeve (40) is inserted into the mounting hole (61) in the ceramic seat (60) of the stationary toilet so that the nut (20) and the washer (30) are hung under a back of the mounting hole (61);

hanging arms (42) of two sides of the shaft sleeve (40) are respectively provided with a upper guide groove (421) and a lower guide groove (422), two upper guide grooves (421) and two lower guide grooves (422) are all parallel to an axial direction of the shaft sleeve (40), and bottoms of the upper guide grooves (421) are narrowed to be steps (423) and connect to tops of the lower guide grooves (422);

two sides of the washer (30) are respectively fixed with a rotating shaft (301), and the rotating shafts (301) slidingly engages with the upper guide grooves (421), two sides of the nut (20) have a guide rib (22) respectively, and the guide ribs (22) slidingly engages with the lower guide grooves (422); the steps (423) shelves the rotating shafts (301) so that the washer (30) is overhanging;

the bolt (10) insertable into the shaft sleeve (40) and screwable to a screw hole (21) of the nut (20), when the nut (20) moves up along the lower guide grooves (422), the nut (20) wedges the washer (30) so that the washer (30) can rotate 90° to expose out of the shaft sleeve (40) in a horizontal state; the nut (20) pushes the horizontal washer (30) to be hooked on the back of the mounting hole (61) while moving along the upper guide grooves (421).

2. The locking assembly for facilitating disassembly and assembly of a toilet cover plate on a mounting hole according to claim 1, wherein the rotating shafts (301) are located on a side of a gravity centre of the horizontal washer (30) and the gravity centre of the washer (30) is located under the rotating shaft (301) when the washer (30) is in an overhanging state.

3. The locking assembly for facilitating disassembly and assembly of a toilet cover plate on a mounting hole according to claim 1, wherein the shaft sleeve (40) further comprises a fastening ring (41) connected at a top of the two hanging arms (42) and a base plate (43) connected at a bottom of the two hanging arms (42), a through groove (44) is formed between the two hanging arms (42) so that two ends of the washer (30) can swing in the through groove (44).

4. The locking assembly for facilitating disassembly and assembly of a toilet cover plate on a mounting hole according to claim 3, wherein the fastening ring (41) is provided with a socket (411) for inserting the bolt (10) into the shaft sleeve (40), the fastening ring (41) is surrounded by fins (412), and when the fastening ring (41) is inserted into the mounting hole (61), the fins (412) deform and press against a inner wall of the mounting hole (61) to fix the fastening ring (41).

5. The locking assembly for facilitating disassembly and assembly of a toilet cover plate on a mounting hole according to claim 3, wherein the base plate (43) is provided with a let-through hole (431) through which the bolt (10) passes.

6. The locking assembly for facilitating disassembly and assembly of a toilet cover plate on a mounting hole according to claim 1, wherein the washer (30) comprises two strip side plates (31) which are parallel to each other, each of the side plates (31) has an upper edge (311) that can be pressed against the back of the mounting hole (61) and a lower edge (312) that can be pressed against the top of the nut (20); a limit plate (32) is provided between the lower edge (312) of the two side plates (31), and a spacing (33) is formed between the two side plates (31), the spacing (33) let the bolt (10) go through; when the washer (30) is in overhanging state, the two side plates (31) are parallel to an axial direction of the bolt (10), when the washer (30) is in horizontal state, the limit plate (32) is perpendicular to an axial direction of the bolt (10) and clamps with the nut (10).

7. The locking assembly for facilitating disassembly and assembly of a toilet cover plate on a mounting hole according to claim 6, wherein other ends of the two side plates (31) are respectively provided with a wedge inclined surface (313), while the washer (30) is upright, the nut (20) is pushed upwards against the wedge inclined surface (313); and the nut (20) pushes the wedge inclined surface (313) so that the washer (30) rotates to be in inclined state.

8. The locking assembly for facilitating disassembly and assembly of a toilet cover plate on a mounting hole according to claim 6, wherein the lower edges (312) of the two side plates (31) is provided with a recessed clamping part (314) matching with a side edge of the limit plate (32), the recessed clamping part (314) is fitted with a side of the nut (20) when the washer (30) is turned horizontally.

9. The locking assembly for facilitating disassembly and assembly of a toilet cover plate on a mounting hole according to claim 6, wherein the rotating shafts (301) on both sides of the washer (30) are protruded on the two side plates (31) of outer side of the spacing (31).

* * * * *